US008102324B2

(12) United States Patent
Tuau et al.

(10) Patent No.: US 8,102,324 B2
(45) Date of Patent: Jan. 24, 2012

(54) SUB-REFLECTOR OF A DUAL-REFLECTOR ANTENNA

(75) Inventors: Denis Tuau, Trignac (FR); Armel Le Bayon, Trignac (FR)

(73) Assignee: Alcatel Lucent, Paris (FR)

( * ) Notice: Subject to any disclaimer, the term of this patent is extended or adjusted under 35 U.S.C. 154(b) by 562 days.

(21) Appl. No.: 12/355,114

(22) Filed: Jan. 16, 2009

(65) Prior Publication Data

US 2009/0184886 A1 Jul. 23, 2009

(30) Foreign Application Priority Data

Jan. 18, 2008 (FR) ..... 08 50301

(51) Int. Cl.
*H01Q 13/00* (2006.01)

(52) U.S. Cl. ..... 343/781 P; 343/781 CA; 343/781 R

(58) Field of Classification Search ..... 343/781 P, 343/781 CA, 781 R, 786, 840, 775
See application file for complete search history.

(56) References Cited

U.S. PATENT DOCUMENTS 6,020,859 A * 2/2000 Kildal ..... 343/781 CA
6,107,973 A * 8/2000 Knop et al. ..... 343/781 P
6,724,349 B1 * 4/2004 Baird et al. ..... 343/781 CA
6,919,855 B2 * 7/2005 Hills ..... 343/781 CA
6,985,120 B2 * 1/2006 Lewry et al. ..... 343/781 CA
6,995,727 B2 * 2/2006 Tuau et al. ..... 343/781 CA
2003/0184486 A1 * 10/2003 Shafai et al. ..... 343/779

FOREIGN PATENT DOCUMENTS

EP 0 439 800 A1 8/1991
GB 973583 10/1964

OTHER PUBLICATIONS

French Search Report.

* cited by examiner

*Primary Examiner* — Hoang V Nguyen
(74) *Attorney, Agent, or Firm* — Fay Sharpe LLP

(57) ABSTRACT

The aim of the present invention is a sub-reflector of a dual-reflector antenna comprising:

- a first end having a junction of a first diameter, adapted for coupling to the end of a waveguide,
- a second end, having a second diameter greater than the first diameter,
- a convex reflective internal surface placed at the second end having an axis of revolution,
- an external surface of the same axis, joining the two ends,
- a dielectric material extending between the first and the second ends and limited by the internal surface and the external surface, In accordance with the invention, the external surface has a convex profile described by a polynomial equation of the sixth degree of the formula:

$y=ax^6+bx^5+cx^4+dx^3+ex^2+fx+g$ where a is not zero.

5 Claims, 6 Drawing Sheets

SUB-REFLECTOR OF A DUAL-REFLECTOR ANTENNA

CROSS-REFERENCE TO RELATED APPLICATIONS

This application is based on French Patent Application No 08 50 301 filed on Jan. 18, 2008, the disclosure of which is hereby incorporated by reference thereto in its entirety, and the priority of which is hereby claimed under 35 U.S.C. §119.

BACKGROUND OF THE INVENTION

The present invention relates to radio frequency (RF) dual-reflector antennas. These antennas comprise in general a concave primary reflector of great diameter exhibiting a surface of revolution, and a convex sub-reflector of lesser diameter situated in the vicinity of the focal point of the primary reflector. These antennas operate equally well in transmitter mode or in receiver mode, corresponding to two opposite directions of RF wave propagation. In the following, the description is given either in transmission mode or in reception mode of the antenna, according to whichever one better illustrates the described phenomena. It should be noted that all of the arguments apply just as well to both receiving antennas and transmitting antennas.

The first antennas only had a single reflector, usually parabolic. The end of the radio frequency waveguide is located at the reflector's focal point. The waveguide is inserted into an opening situated on the axis of the reflector, and its end is folded to 180° in order to be opposite the reflector. The maximum half angle of radiation, at the folded end of the waveguide for lighting up the reflector is low, in the region of 70°. The distance between the reflector and the end of the waveguide should be sufficiently extensive to permit the lighting up of the entire surface of the reflector. For these shallow reflector antennas, the F/D ratio is in the region of 0.36. In this ratio, F is the focal length of the reflector (distance between the vertex of the reflector and its focal point) and D is the diameter of the reflector.

In these antennas, the value of the diameter D is determined by the central operating frequency of the antenna. The lower the operating frequency of the antenna (for example 7.1 GHz or 10 GHz) and the more important the diameter of the reflector is for the equivalent antenna gain, the further away the end of the waveguide must be from the reflector to light it up well (transmission mode). The antenna therefore becomes all the more bulky the lower the operating frequency. For these shallow reflector antennas, it is essential to add a dark trace screen in order to minimize the radiation losses by spillover and improve the radio performance.

In order to create a more compact system, one utilizes dual-reflector antennas, in particular those of the Cassegrain type. The dual-reflectors comprise a concave primary reflector, frequently parabolic, as well as a convex sub-reflector having a much lower diameter and placed in the proximity of the focal point on the same axis of revolution as the primary reflector. The primary reflector is bored at its vertex and the waveguide is inserted on the axis of the primary reflector. The end of the waveguide is no longer folded, but rather is opposite the sub-reflector. In transmission mode, the RF waves transmitted by the waveguide are reflected by the sub-reflector to the primary reflector.

It is possible to create sub-reflectors exhibiting a half-angle of illumination of the primary reflector far greater than 70°. For example one can use a half-angle limit of illumination of 105°. In a dual-reflector antenna, the sub-reflector can also be axially quite close to the primary reflector. In practice, the sub-reflector can be situated within the volume defined by the primary reflector, which reduces the space occupied by the antenna.

In these dual-reflector antennas, the utilized F/D ratio is often less than or equal to 0.25. These antennas are called deep reflectors. An F/D ratio in the region of 0.25 corresponds, for an equal value of the central operating frequency D, to a much shorter focal length than is the case where the F/D ratio is close to 0.36. The space occupied by a dual-reflector antenna may well be less than that of a simple reflector antenna thanks to the suppression of the dark trace screen which is no longer essential.

Although the dual-reflector antennas are well adapted to the creation of compact antennas, for example when using the dual-reflectors where the F/D ratio is close to 0.2, one may prefer using the different values of the F/D so as to optimize other characteristics than the occupied space, such as the radiation pattern of the antenna for example.

With a dual-reflector antenna, the sub-reflector should be kept near the primary reflector's focal point. One of the possible ways is to attach the sub-reflector to the end of the waveguide. In this case, the sub-reflector generally consists of dielectric material (usually plastic) more or less cone-shaped and transparent to RF waves. The more or less cone-shaped external surface of the sub-reflector is opposite the primary reflector. The convex internal surface of the sub-reflector is coated with a product enabling the reflection of the RF waves in the direction of the primary reflector when passing through the dielectric material. This coating is usually metallic.

Multiple reflections of the RF waves take place between the end of the waveguide and the primary reflector, involving the sub-reflector. To reduce these reflections, one has proposed introducing local disruptions on the external surface of the sub-reflector opposite the primary reflector. These disruptions have the shape of contours forming rings around the dielectric material. The annular contours are contours of revolution around the axis of the sub-reflector. The profile of these annular contours is made up of crests and projections of different altitudes and depths. These contours can be distributed periodically on the entire external surface of the sub-reflector. However, non-periodic annular contours can be used to modify the reflection characteristics of the sub-reflector, in order to reduce once more the multiple reflections of the RF waves for the two planes of polarization of the electromagnetic wave.

The introduction of annular contours on the external surface of the dielectric material permits the reduction of the multiple reflections of the RF waves which are produced between the waveguide and the primary reflector via the internal metal-plated surface of the sub-reflector. On the other hand, these contours have a lesser effect on two other important properties of the dual-reflector: the antenna gain, expressed in dBi or isotropic decibels, and the losses by spillover, expressed in dB.

In antenna transmission mode, for example, the losses by spillover correspond to the energy reflected by the sub-reflector in the direction of the primary reflector, and whose path ends beyond the external diameter of the primary reflector. These losses lead to a pollution of the environment by the RF waves. These losses by spillover must be limited to the levels defined by the standards.

One customary solution for remedying this is attaching to the periphery of the primary reflector a shroud which has the shape of a cylinder, of a diameter close to that of the primary reflector and of suitable height, coated inwardly with an RF radiation absorbing layer. Besides the congestion which results from it, this known solution exhibits the nowadays awkward drawback of the cost of the shroud material, as well as the cost of the assembly of this shroud on the primary reflector.

SUMMARY OF THE INVENTION

The aim of the present invention is to propose a dual-reflector antenna for which the losses by spillover are considerably reduced.

The object of the present invention is a sub-reflector of a dual-reflector antenna comprising

- a first end having a junction of a first diameter, adapted for coupling to the end of a waveguide,
- a second end, having a second diameter greater than the first diameter,
- a convex internal reflective surface placed at the second end, having an axis of revolution,
- an external surface of the same axis joining the two ends,
- a dielectric material extending between the first and the second ends and limited by the internal surface and the external surface, According to the invention, the external surface has a convex profile described by a polynomial equation of the sixth degree of the formula:

$$y=ax^6+bx^5+cx^4+dx^3+ex^2+fx+g \text{ where a is not zero.}$$

The invention consists in proposing a sub-reflector where the external surface exhibits a profile in accordance with a special curve. The sub-reflector is a volume of axial symmetry having a surface where the generating line is a curve described by a polynomial equation of the 6th degree. Some numerical optimizations allow the adaptation of the coefficients of this polynomial equation of the 6th degree in accordance with the type of dual-reflector utilized and the possible presence of a shroud.

In the equation:

$y=ax^6+bx^5+cx^4+dx^3+ex^2+fx+g$, one or more coefficients among the coefficients b, c, d, e, f and/or g can be zero.

In one variant of the invention, the external surface of the sub-reflector comprises in addition a unique contour in the shape of a ring surrounding the dielectric material.

The cross-section of this contour can be a part of a disk or of a parallelogram (square or rectangle for example). Preferably the contour has a rectangular cross-section.

Preferably also the contour projects in a direction perpendicular to the axis of revolution of the sub-reflector.

This unique contour ring is placed on the external surface of the sub-reflector to reduce the multiple reflections of the RF wave. One also simultaneously obtains a reduction of spillover losses and of multiple reflections of RF waves. Preferably the contour is arranged on the half of the external surface the closest to the second end.

The present invention also has as its object a dual-reflector antenna comprising a primary reflector and an associated sub-reflector. The sub-reflector comprises:

- a first end having a junction of a first diameter, adapted for coupling to the end of a waveguide,
- a second end, having a second diameter greater than the first diameter,
- a convex internal reflective surface placed at the second end, having an axis of revolution,
- a dielectric material extending between the first and the second ends and limited by the internal surface and the external surface,
- an external surface of the same axis, placed as close as possible to the primary reflector, having a convex profile described by a polynomial equation of the sixth degree of the formula:

$$y=ax^6+bx^5+cx^4+dx^3+ex^2+fx+g \text{ where a is not zero.}$$

As a result of the reduction of the losses by spillover, the present invention makes it possible to do without the shroud, or at the very least to reduce the height of the shroud of the primary reflector, which brings an advantage in cost and in bulk.

The improvement provided by the invention allows the use of a shroud of low height which can be realized in a single component with the primary reflector, that is to say that one realizes a single mechanical part exhibiting a reflector in the central part and a shroud in the peripheral part. The more classic solution involves a shroud fitted on a primary reflector by any known method such as welding, screwing, etc. The present invention therefore reduces additional costs since the cost of assembly is removed.

The invention can be used in applications such as, for example, the realization of terrestrial antennas allowing the reception of a radiofrequency signal emitted by a satellite or the link between two terrestrial antennas, and in a more general manner in any application relating to point to point radiofrequency links in the frequency band of 7 GHz to 40 GHz. The typical central operating frequencies of these systems are 7.1 GHz, 8.5 GHz, 10 GHz, etc. . . . The bandwidth around each frequency is generally in the region of 5% to 20%. Each central frequency corresponds to an adapted diameter of the sub-reflector: the more the frequency is elevated, the lower the wavelength is and the more the diameter of the sub-reflector is reduced.

BRIEF DESCRIPTION OF THE DRAWINGS

The invention will be better understood and other advantages and features will come to light upon the reading of the following description of embodiments, given on an illustrative, non-limiting basis, accompanied by appended drawings, among which:

In FIGS. 7 and 8, the amplitude in dBi of the radiation V on the vertical plane and of the radiation H on the horizontal plane respectively of the sub-reflector are given as a y-coordinate, and as an x-coordinate the half-angle of illumination θ in degrees.

In FIGS. 9 through 11, the radiation T of the primary reflector is expressed in dB as a y-coordinate and as an x-coordinate the half-angle β□ expressed in degrees. The radiation T of the primary reflector is standardized to 0 dB for a half-angle β equal to zero degrees.

DETAILED DESCRIPTION OF THE PREFERRED EMBODIMENTS

Figure 1:
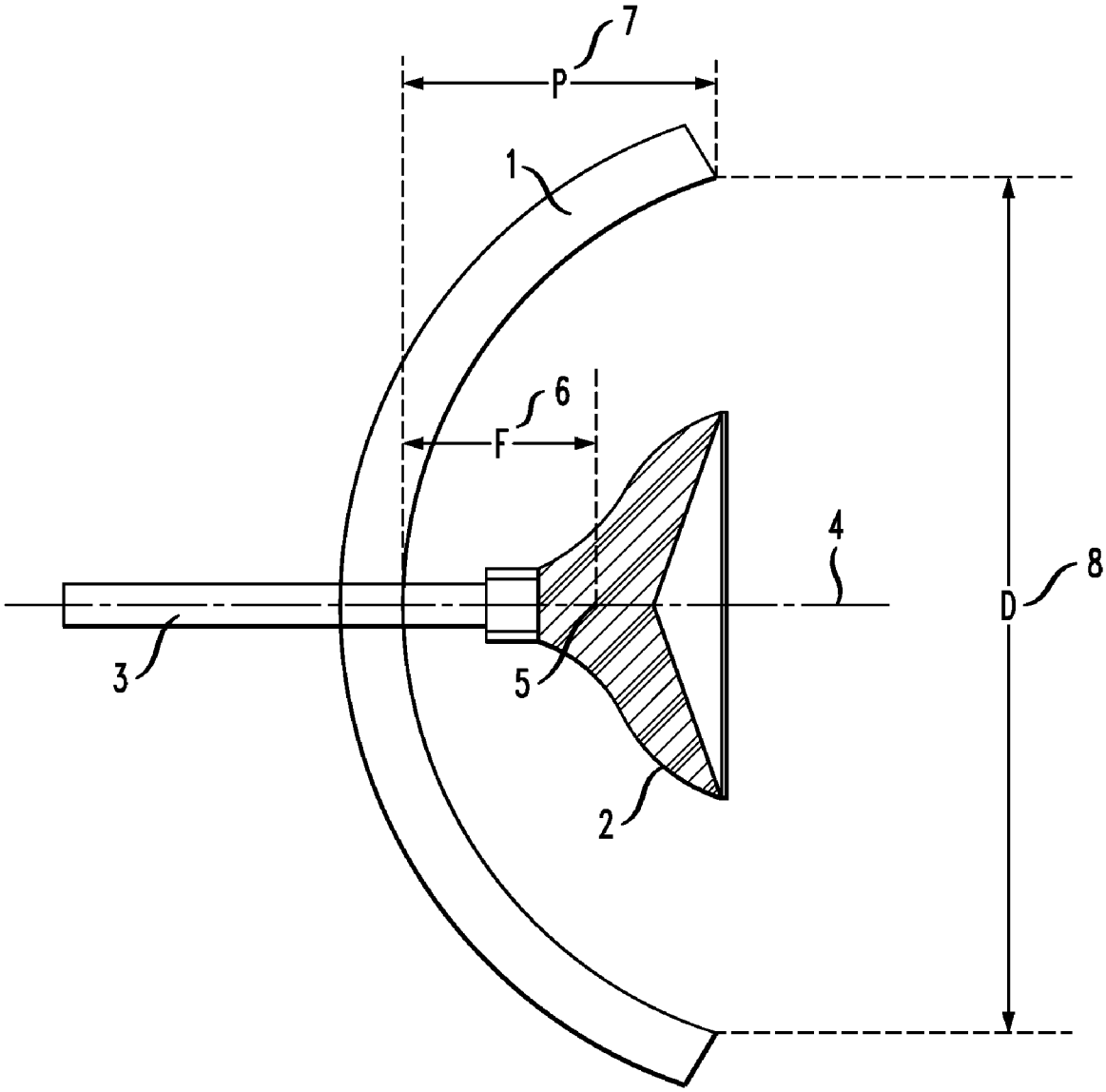
FIG. 1 represents a schematic axial sectional view of a radiofrequency antenna in accordance with a first embodiment of the invention.

In FIG. 1, an RF antenna in accordance with a first embodiment of the invention is represented in axial section. This antenna comprises an assembly made up of a concave primary reflector 1 and of a sub-reflector 2, as well as of a waveguide 3 serving moreover as support mechanism to the sub-reflector 2. The assembly exhibits a rotational symmetry around the axis 4.

The primary reflector 1 can be made of metal with a reflective surface, for example aluminum. The waveguide 3 can be for example a hollow metallic tube, also made of aluminum, of circular cross-section having an exterior diameter of 26 mm or 3.6 mm for frequencies of transmission/reception respectively of 7 GHz and 60 GHz. Of course the waveguide could have a different cross-section, rectangular or square for example.

One has represented the focal point 5 (also called phase center) placed on the axis of revolution 4, and the focal length F 6 which separates the focal point 5 from the vertex of the primary reflector 1. The primary reflector 1 is for example a paraboloid of revolution around the axis 4 with a depth P 7 and a diameter D 8.

For such an antenna exhibiting an F/D ratio in the region of 0.2, the focal length F is for example 246 mm and the diameter D is 1230 mm (4 feet). In that case, the angle of illumination limit $2\theta_p$ of the primary reflector is 210°.

Figure 2:
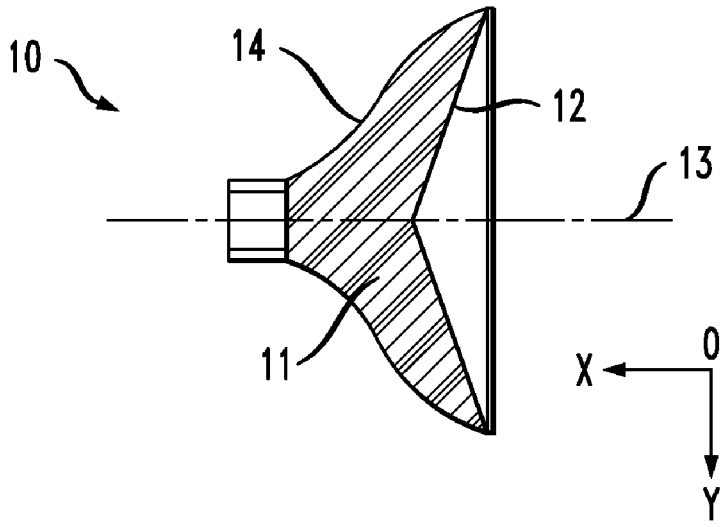
FIG. 2 shows a schematic axial sectional view of the sub-reflector of the RF antenna in accordance with a first embodiment of the invention.

FIG. 2 represents the sub-reflector 10 of the antenna in accordance with the first embodiment of the invention. The dielectric material 11 of the sub-reflector can be made of a dielectric material like plastic. The internal surface 12 of the sub-reflector 10 can be a surface of revolution described by a polynomial equation around the axis of revolution 13. The internal surface 12 can be covered in a reflective metal, such as silver.

The external surface 14 of the sub-reflector 10 is the surface placed in comparison with the primary reflector. The external surface 14 is a surface of revolution around the axis of revolution 13.

In accordance with the first embodiment of the invention, the external surface 14 of the sub-reflector 10 exhibits a profile which is a curve described by a polynomial equation of the sixth degree of the formula:

$$y=ax^6+bx^5+cx^4+dx^3+ex^2+fx+g.$$

The calculations make it possible to show that the choice of such a curved profile for the external surface 14 allows the reduction of the losses by spillover of the dual-reflector.

Figure 3:
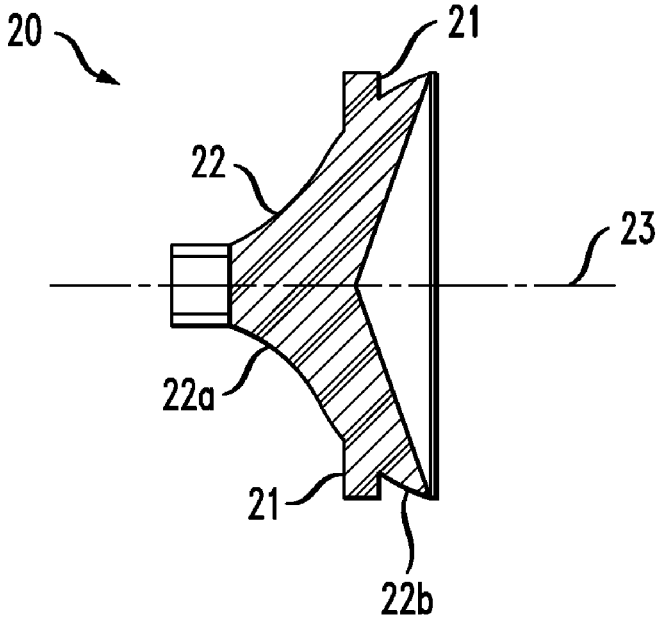
FIG. 3 shows a schematic axial sectional view of the sub-reflector of an RF antenna in accordance with a second embodiment of the invention.

The shape of the internal surface of the sub-reflector influences the intensity and the phase of the electromagnetic wave stemming from the waveguide and received by the primary reflector. hh FIG. 3 represents the sub-reflector 20 of an antenna in accordance with a second embodiment of the invention. A contour 21 forming a ring is arranged on the external surface 22 of the reflector 20. The profile of the external surface 22 on both sides of the contour 21 is a curve described by a polynomial equation of the sixth degree of the formula:

$$y=ax^6+bx^5+cx^4+dx^3+ex^2+fx+g$$

In the second embodiment of the invention, the external surface 22 of the reflector 20 is thus made up of three successive parts 22*a*, 21, 22*b*. The parts 22*a* and 22*b* each exhibit a profile described by a portion of the curve of the sixth degree. The parts 22*a* and 22*b* and the contour 21 exhibit an axisymmetry around the axis of revolution 23.

Figure 4:
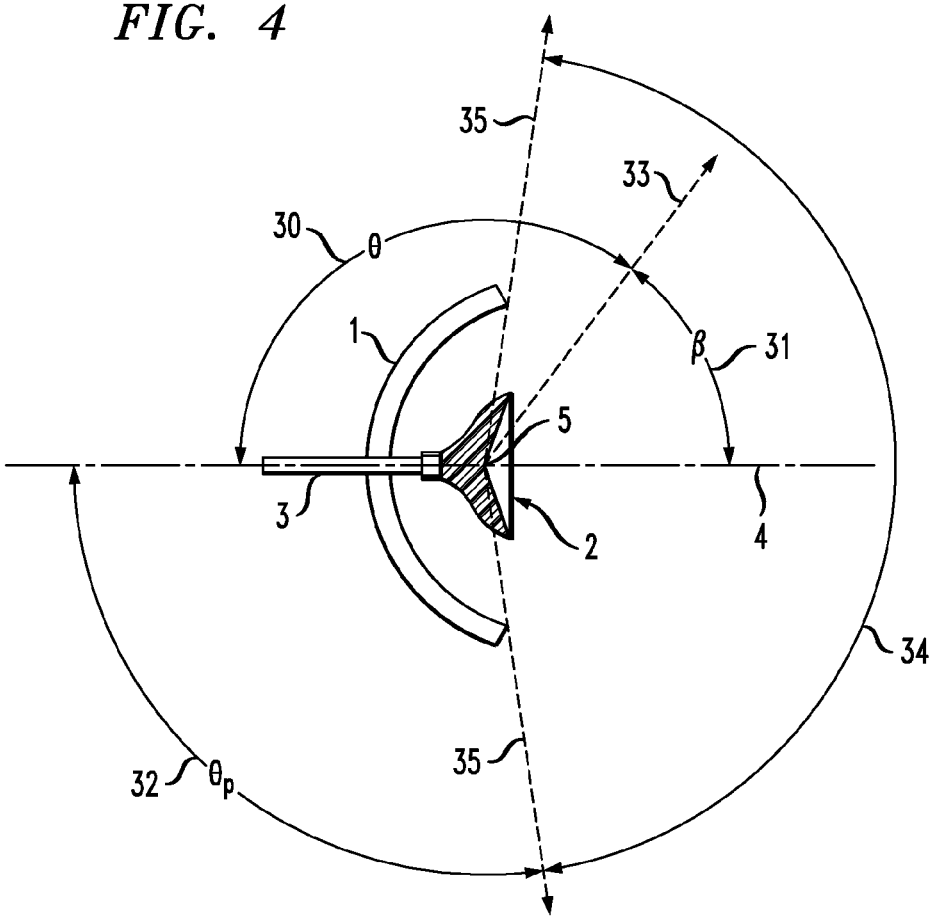
FIG. 4 is a general schematic view of the radiation parameters of a dual-reflector antenna similar to that of FIG. 1.

The losses by spillover for transmission mode of an RF antenna in accordance with the first embodiment of the invention are clarified in FIG. 4. These losses correspond to the values of the angle of illumination 2θ of the primary reflector by the sub-reflector for which the RF waves stemming from the waveguide 3 are reflected by the sub-reflector 2 in a direction which is outside the perimeter of the primary reflector 1.

This figure shows the half-angle of illumination θ (theta) 30 and the half-angle β (beta) 31, which is the complementary half-angle to the half-angle θ. The two half-angles θ and β are measured in comparison with the axis of revolution 4 of the sub-reflector 2, and they have the focal point 5 of the primary reflector 1 for vertex. There is a loss by spillover for the values of the half-angle θ greater than the threshold value $\theta_p$ 32 for which the rays reflected 33 by the sub-reflector happen to be tangents at the edge of the primary reflector 1.

The losses by spillover are thus due to all the rays 33 reflected by the sub-reflector 2 within the angular range 34. The angular range 34 is defined by two rays 35, stemming from the focal point 5 and symmetrical in relation to the axis of revolution 4, which are tangent to the edges of the primary reflector 1.

Figure 5:
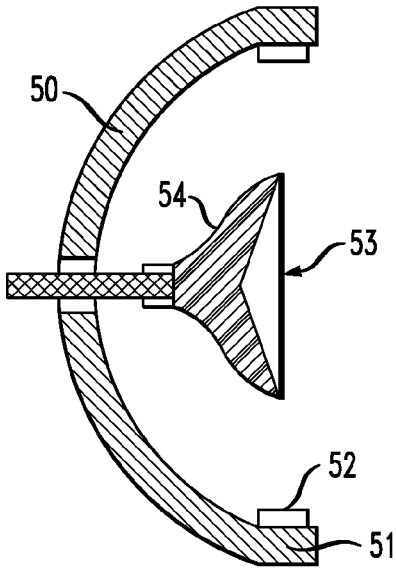
FIG. 5 represents a schematic axial sectional view of an RF antenna where the primary reflector comprises a shroud in accordance with a third embodiment of the invention.

FIG. 5 represents a view in axial section of an RF antenna in accordance with a variant of the first embodiment of the invention. The primary reflector 50 is equipped with a shroud 51 in order to limit the losses by spillover. The shroud 51 is a screen covered with a material 52 that absorbs the RF waves. For example, the shroud 51 is made of aluminum and the absorbing layer 52 is made up of a foam charged with carbon monoxides.

The shroud 51 is of a height here that is less than that of the shrouds used in the prior art, because the losses by spillover are considerably reduced by the use of a sub-reflector 53 equipped with an external surface 54 exhibiting a profile in accordance with a curve described by a polynomial equation of the sixth degree. One can optimize the parameters of the equation of the sixth degree describing the profile of the external surface 54. This optimization allows the reduction of the height of the shroud 51 up to allowing the realization of a single component of the primary reflector 50 and of the shroud 51, as shown by FIG. 5. The shroud 51 in this way constitutes an extension of the primary reflector 50. This can be realized for example by stamping a single aluminum plate so as to define successively or simultaneously the shape, preferably paraboloid of revolution, of the primary reflector 50 and the shape, preferably cylindrical, of the shroud 51.

Figure 6:
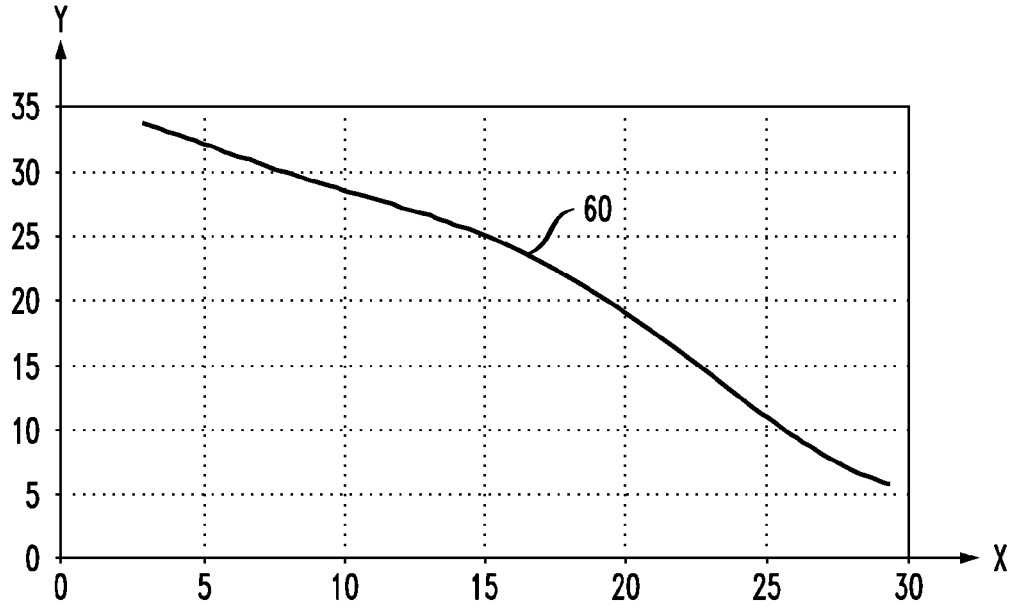
FIG. 6 is an example of the profile of the external surface of the sub-reflector in accordance with a special embodiment of the invention.

FIG. 6 represents an example of the profile 60 of the external surface of the sub-reflector in accordance with a special embodiment of the invention, which has been obtained by digitalization of the level of losses by spillover. The position of axes X and Y, used respectively on the horizontal and vertical axes, is represented in FIG. 2. The reference (X, Y) has as its origin a point of the axis of revolution 13 situated at the level of the second end of the sub-reflector 10. The axis X is aligned on the axis of revolution 13 and the axis Y at a direction perpendicular to the axis of revolution 13. The distances are expressed in centimeters.

The example described in this figure corresponds to a dual-reflector antenna where the primary reflector is of the parabolic type corresponding to the equation: P/D=D/(16F) in which P is the depth of the primary reflector, D is the diameter of the primary reflector, and F is the focal length of the primary reflector.

In this example, F/D=0.25 and the half-angle of illumination limit $\theta_p$ is such that $\theta_p$=90°, because in any parabole $\theta_p$=2 arc tangent (D/4F).

In this example of the realization of the invention, the polynomial equation defining the profile of the external surface of the sub-reflector is the following:

$$y=(-3.904.10^{-7})x^6+(4.658.10^{-5})x^5+(-1.947.10^{-3})x^4+(3.358.10^{-2})x^3+(-2.927.10^{-1})x^2+(3.006.10^{-1})x+(3.462.10)$$

The numerical values indicated here for the parameters a, b, c, d, e, f, g of the equation of the sixth degree depend on the numerical values chosen for the focal length F, the depth P and the diameter D of the primary reflector, as well as the level of losses by spillover which one has authorized. If one changes these numerical values, one can find a different set of values for the parameters a, b, c, d, e, f, g allowing the minimization of the losses by spillover. Thus the parameters a, b, c, d, e, f, g of the equation of the sixth degree can have different values.

Figure 7:
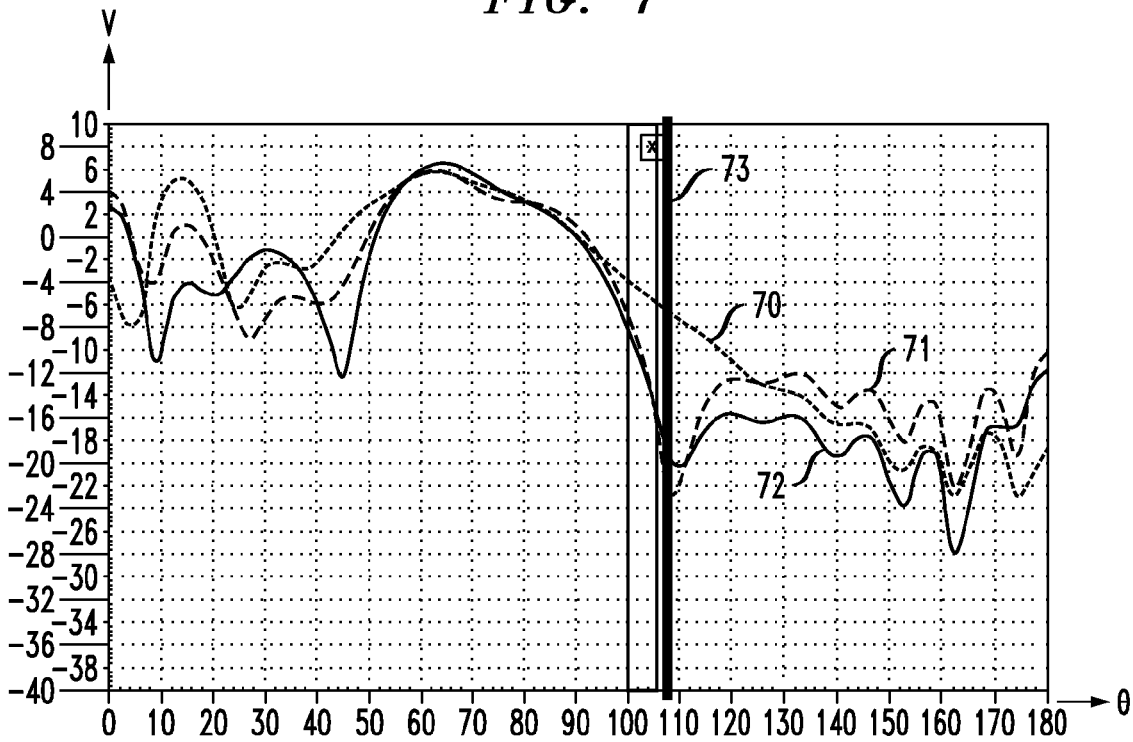
FIG. 7 is the radiation pattern of the sub-reflector on the vertical plane according to the half-angle of illumination θ for three different profiles of the external surface of the sub-reflector, FIG. 8, similar to FIG. 7, is the radiation pattern of the sub-reflector on the horizontal plane according to the half-angle of illumination θ for three different profiles of the external surface of the sub-reflector.

FIG. 7 shows the radiation pattern on the vertical plane of the sub-reflector of a dual-reflector antenna for three different profiles of the external surface of the sub-reflector:

- a known conical profile from prior art (reference curve 70),
- a profile corresponding to the first embodiment of the invention (curve 71), and
- a profile comprising an annular contour in accordance with the second embodiment of the invention (curve 72).

The radiation pattern is represented by the amplitude of the radiation V expressed according to the half-angle of illumination θ. This radiation pattern is relative to the antenna in transmission mode. The better antenna design is the one which makes it possible to obtain a radiation, or transmitted electric field, which is the lowest possible for the values of the half-angle of illumination θ greater than the threshold value $\theta_p$ represented here by the vertical line 73. The vertical line 73 represents the value $\theta_p$ of the half-angle θ□ which is tangent to the external edge of the primary reflector as shown in FIG. 4. For the values of the half-angle θ□ greater than the value $\theta_p$ defined by the vertical line 73, the rays are reflected in the angular range 34 and share in the losses by spillover.

One observes that the curve 71, associated with the first embodiment in accordance with the invention, shows a lower radiation for the values of the angle θ greater than the value $\theta_p$ than the radiation given by the curve 70 associated with a profile from prior art. The curve 72 associated with a second embodiment in accordance with the invention further improves the result obtained with the curve 71.

Figure 8:
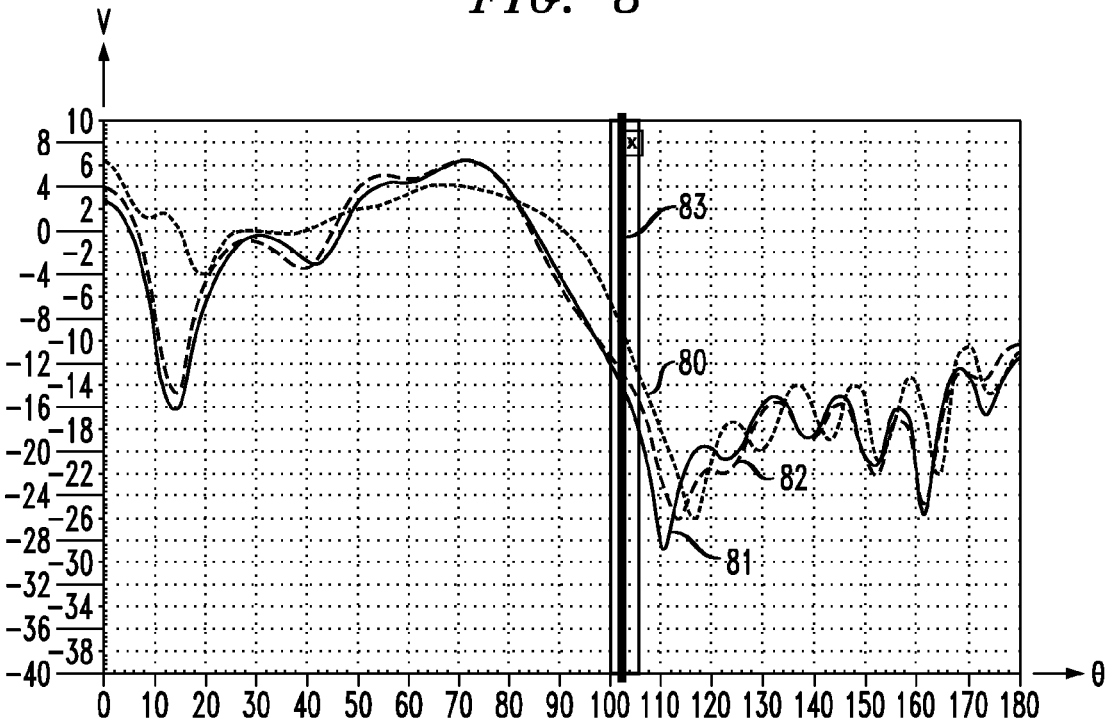

FIG. 8, similar to FIG. 7, represents the radiation pattern of the sub-reflector, this time measured on the horizontal plane, for three different profiles of the external surface of the sub-reflector:

- a known conical profile from prior art (reference curve 80),
- a profile corresponding to the first embodiment of the invention (curve 81), and
- a profile comprising an annular contour in accordance with the second embodiment of the invention (curve 82).

In this figure, the vertical line 83 represents the value $\theta_p$ of the half-angle θ□ which is tangent to the external edge of the primary reflector as shown in FIG. 4.

As in the preceding case, the better conception of antenna is the one which makes it possible to obtain a radiation which is the lowest possible for the half-angles θ, greater than the value $\theta_p$. situated to the right of the vertical line 83. One observes that the curve 81 associated with the first embodiment in accordance with the invention shows radiation values that are lower than the values given by the curve 80 associated with a profile from prior art. The curve 82 associated with a second embodiment in accordance with the invention further improves the result obtained with the curve 81.

Figure 9:
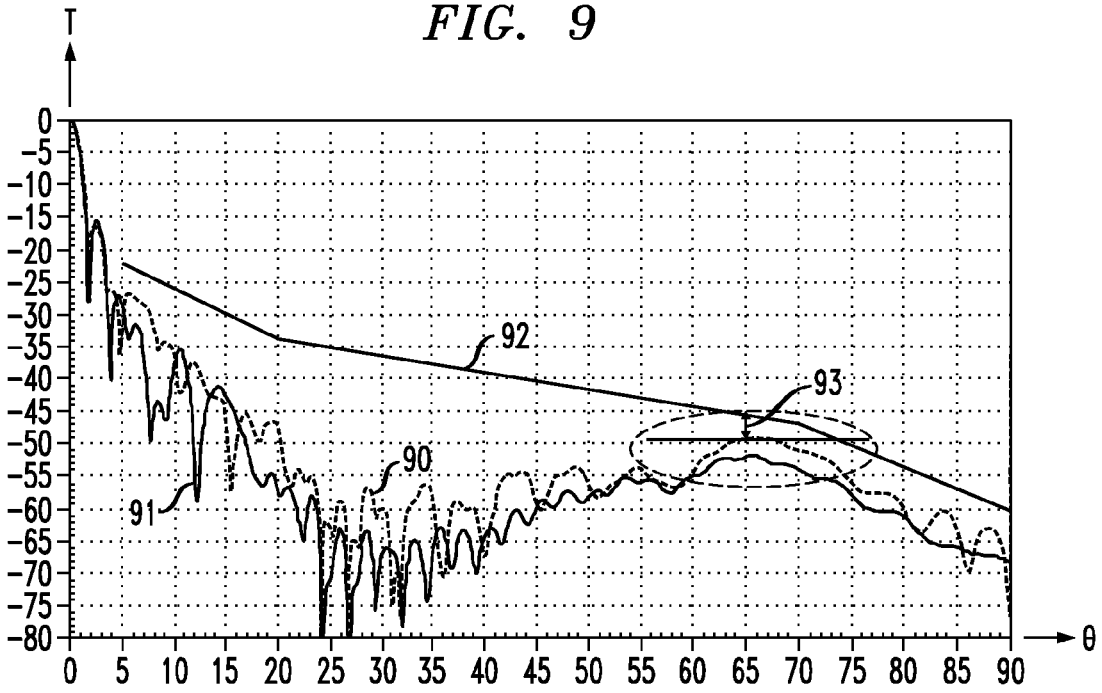
FIG. 9 represents the radiation pattern of the primary reflector according to the half-angle β, supplementary to the half-angle of radiation θ,□ of a dual-reflector antenna in accordance with prior art, FIG. 10, similar to FIG. 9, represents the radiation pattern of the primary reflector according to the half-angle β□ of a dual-reflector antenna in accordance with the first embodiment of the invention, FIG. 11, similar to FIG. 9, represents the radiation pattern of the primary reflector according to the half-angle β□ of a dual-reflector antenna in accordance with the second embodiment of the invention.

FIG. 9 shows the radiation pattern of the primary reflector according to the half-angle β of a dual-reflector antenna in accordance with prior art. The vertical axis represents the power levels reflected on the vertical and horizontal planes of the antenna according to the half-angle β. The curve 90 corresponds to the power reflected on the vertical plane, and the curve 91 corresponds to the power reflected on the horizontal plane.

A dotted line 92 indicates for each value of the half-angle β the limits of reflectivity authorized by the ETSI R1C3 Co standard. For a value of the half-angle β close to 65°, which is the threshold value corresponding to the diffraction of the RF wave on the edge of the primary reflector, the deviation 93 between the value of the radiation of the primary reflector and the threshold value imposed by the standard is here in the region of 5 dB.

Figure 10:
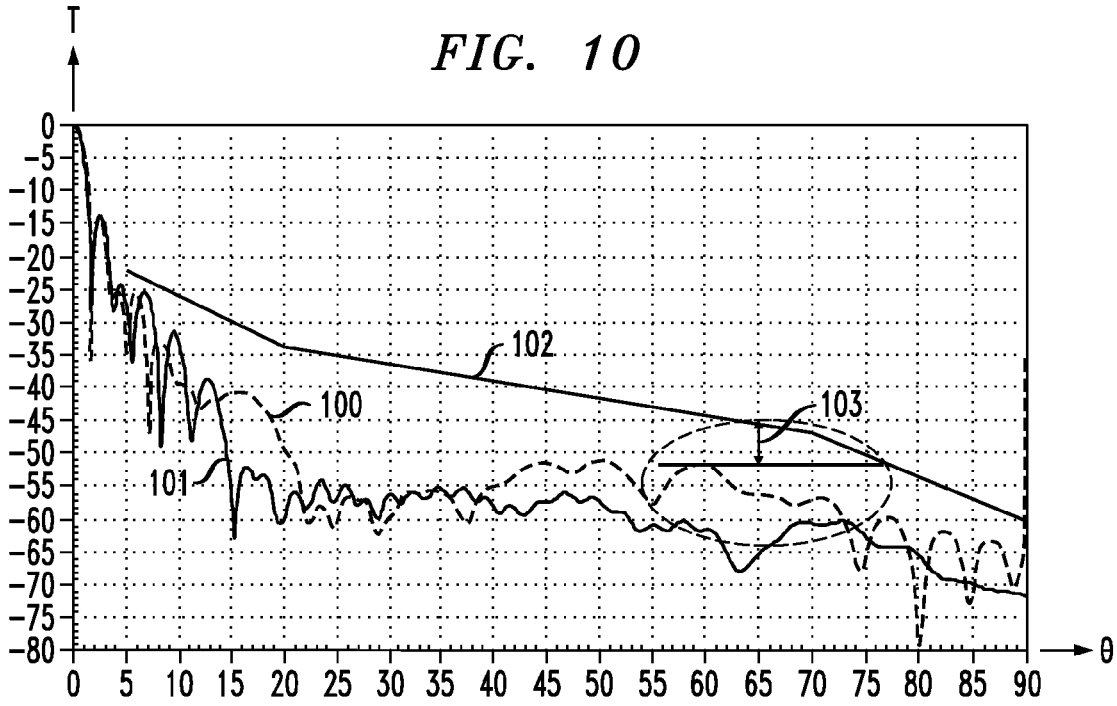

FIG. 10 is relative to a dual-reflector antenna using a sub-reflector in accordance with a first embodiment of the invention. The external surface of the antenna shows a profile described by a polynomial equation of the sixth degree. One has represented the power levels reflected on the vertical and horizontal planes of the antenna according to the half-angle β. The curve 100 corresponds to the power reflected on the vertical plane and the curve 101 corresponds to the power reflected on the horizontal plane. A dotted line 102 indicates, for each value of the half-angle β the limits of reflectivity authorized by the ETSI R1C3 Co standard.

The deviation 103 is here in the region of 7 dB, an increase in comparison with the deviation of 5 dB obtained for an antenna from prior art.

Figure 11:
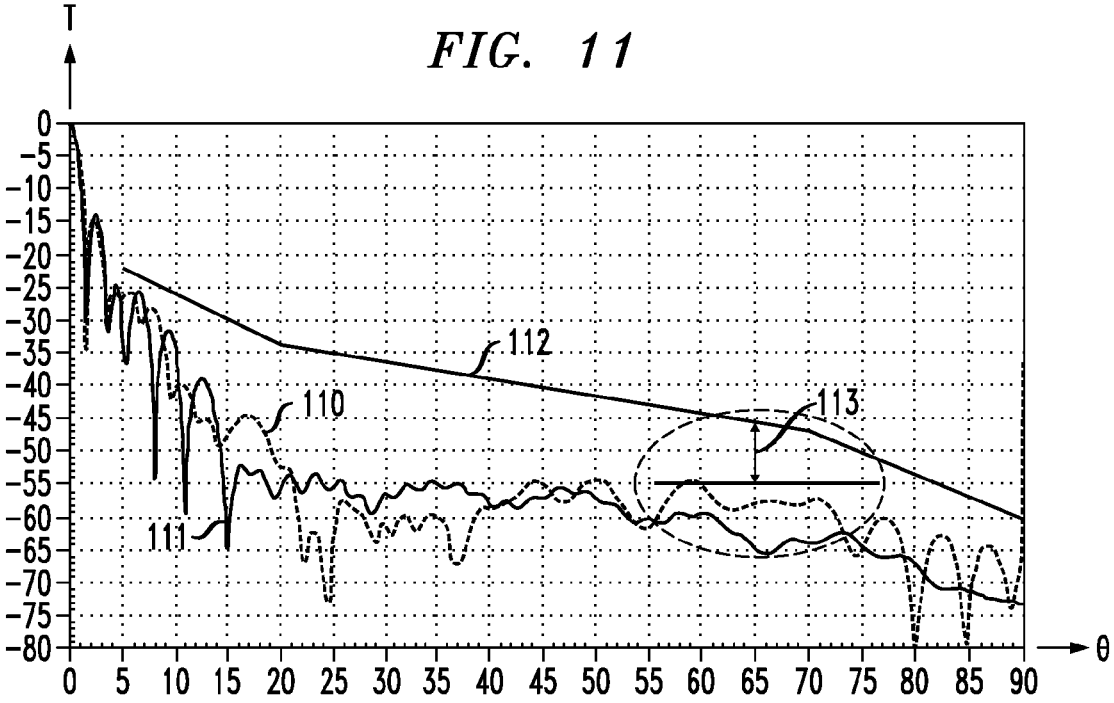

FIG. 11 is relative to a dual-reflector antenna using a sub-reflector in accordance with a second embodiment of the invention. The external surface of the sub-reflector shows a profile described by a polynomial equation of the sixth degree on which an annular contour has been added. One has represented the power levels reflected on the vertical and horizontal planes of the antenna according to the half-angle β. The curve 110 corresponds to the power reflected on the vertical plane and the curve 111 corresponds to the power reflected on the horizontal plane. A dotted line 112 indicates, for each value of the half-angle β the limits of reflectivity authorized by the ETSI R1C3 Co standard.

The deviation 113 is in the region of 9 dB, far greater than the deviation 93 de 5 dB obtained for an antenna from prior art and improved in comparison with the deviation 103 de 7 dB obtained in accordance with the first embodiment of the invention.

The higher this deviation between the value of the radiation of the primary reflector and the threshold value imposed by the ETSI R1C3 Co standard, the lower the intensity of the radiation of the antenna in this angular zone. This quality of the antenna is important for the user because it ensures a lower electromagnetic pollution of the adjoining antennas.

The invention claimed is:

1. Sub-reflector of a dual-reflector antenna comprising:

a first end having a junction of a first diameter, adapted for coupling to the end of a waveguide (3), a second end, having a second diameter greater than the first diameter, a convex reflective internal surface (12) placed at the second end having an axis of revolution (13), an external surface (14) of the same axis (13), joining the two ends, a dielectric material (11) extending between the first and the second end and limited by the internal surface (12) and the external surface (13), characterized in that the external surface (14) has a convex profile described by a polynomial equation of the sixth degree of the formula:

$$y=ax^6+bx^5+cx^4+dx^3+ex^2+fx+g \text{ where a is not zero.}$$

2. Sub-reflector in accordance with claim 1, wherein the external surface (22) comprises in addition a unique contour (21) in the shape of a ring surrounding the dielectric material (11).

3. Sub-reflector in accordance with claim 2, wherein the contour (21) projects in a direction perpendicular to the axis of revolution (23).

4. Dual-reflector antenna comprising a primary reflector (1) and an associated sub-reflector (2, 10,), characterized in that the sub-reflector (2, 10) comprises:

a first end having a junction of a first diameter, adapted for coupling to the end of a waveguide (3), a second end, having a second diameter greater than the first diameter, a convex reflective internal surface (12) placed at the second end having an axis of revolution (13), an external surface (14) of the same axis (13), placed as close as possible to the primary reflector (1), having a convex profile described by a polynomial equation of the sixth degree of the formula:

$$y=ax^6+bx^5+cx^4+dx^3+ex^2+fx+g \text{ where a is not zero,}$$

a dielectric material (11) extending between the first and the second end and limited by the internal surface (12) and the external surface (14).

5. Dual-reflector antenna in accordance with claim 4, comprising a primary reflector (50) comprising a shroud, the shroud (51) and the primary reflector (50) being made of a single component.

* * * * *